US008935985B2

(12) United States Patent
Hjelm

(10) Patent No.: US 8,935,985 B2
(45) Date of Patent: Jan. 20, 2015

(54) POWER DISTRIBUTION CONTROL OF A FURNITURE ARRANGEMENT

(71) Applicant: KIH-utveckling AB, Jönköping (SE)

(72) Inventor: Johan Hjelm, Bankeryd (SE)

(73) Assignee: KIH-utveckling AB, Jönköping (SE)

( * ) Notice: Subject to any disclaimer, the term of this patent is extended or adjusted under 35 U.S.C. 154(b) by 0 days.

(21) Appl. No.: 13/760,761

(22) Filed: Feb. 6, 2013

(65) Prior Publication Data

US 2013/0199421 A1 Aug. 8, 2013

(30) Foreign Application Priority Data

Feb. 7, 2012 (EP) ..... 12154166

(51) Int. Cl.
*A47B 37/00* (2006.01)
*A47B 21/00* (2006.01)
*A47B 21/06* (2006.01)

(52) U.S. Cl.
CPC ..... *A47B 21/00* (2013.01); *A47B 21/06* (2013.01)
USPC ..... 108/50.01

(58) Field of Classification Search
USPC ..... 108/50.01, 50.02, 147, 20; 307/104, 307/149; 340/13.24, 12.31
See application file for complete search history.

(56) References Cited

U.S. PATENT DOCUMENTS 4,685,255 A * 8/1987 Kelley ..... 439/215
5,152,698 A * 10/1992 Juhlin et al. ..... 439/215
5,268,666 A * 12/1993 Michel et al. ..... 340/12.37
5,806,943 A * 9/1998 Dell et al. ..... 312/223.3
6,133,845 A * 10/2000 Toms et al. ..... 340/12.39
6,269,753 B1 * 8/2001 Roddan ..... 108/50.01
6,747,204 B2 * 6/2004 DeLand ..... 174/50
6,796,247 B1 * 9/2004 Iglseder et al. ..... 108/50.01
7,262,700 B2 * 8/2007 Hsu ..... 340/572.1
7,490,559 B2 * 2/2009 Bentschneider ..... 108/50.01
7,828,253 B2 * 11/2010 Meyer ..... 108/50.01
8,061,864 B2 * 11/2011 Metcalf et al. ..... 307/150
8,240,257 B2 * 8/2012 Frost ..... 108/20
2004/0026998 A1 * 2/2004 Henriott et al. ..... 307/9.1

(Continued)

FOREIGN PATENT DOCUMENTS

DE 102009056152 A1 6/2011
NL 2001098 C2 6/2009
WO WO-2007045238 A1 4/2007

OTHER PUBLICATIONS

European Search Report for Application No. 12154166.8 dated Jul. 7, 2012.

(Continued)

*Primary Examiner* — Jose V Chen
(74) *Attorney, Agent, or Firm* — Harness, Dickey & Pierce P.L.C.

(57) ABSTRACT

Example embodiments relate to a furniture arrangement including a piece of furniture and a control unit adapted to control a power supply to at least one power consuming device. The piece of furniture may include an interface for connection to a mobile device, wherein the control unit is adapted to disconnect the power supply to the at least one power consuming device when a mobile device is not connected to the furniture arrangement via the interface.

20 Claims, 4 Drawing Sheets

(56) References Cited

U.S. PATENT DOCUMENTS

| | | | | |
|---|---|---|---|---|
| 2008/0087202 | A1* | 4/2008 | George et al. | 108/50.01 |
| 2009/0072782 | A1* | 3/2009 | Randall | 307/149 |
| 2009/0106567 | A1* | 4/2009 | Baarman | 713/300 |
| 2009/0212636 | A1* | 8/2009 | Cook et al. | 307/104 |
| 2009/0212638 | A1* | 8/2009 | Johnson | 307/104 |
| 2010/0055928 | A1* | 3/2010 | Randall | 439/1 |
| 2010/0201202 | A1* | 8/2010 | Kirby et al. | 307/104 |
| 2010/0213895 | A1* | 8/2010 | Keating et al. | 320/108 |
| 2010/0219698 | A1* | 9/2010 | Azancot et al. | 307/104 |
| 2010/0276482 | A1 | 11/2010 | Raihi et al. | |

OTHER PUBLICATIONS

European Patent Office communication dated Jul. 9, 2014 for corresponding European Application No. 12 154 166.8.

* cited by examiner

POWER DISTRIBUTION CONTROL OF A FURNITURE ARRANGEMENT

CROSS REFERENCE TO RELATED APPLICATIONS

This application claims priority to European Application Number 12154166.8 filed Feb. 7, 2012, the entire contents of each of which are hereby incorporated herein by reference.

TECHNICAL FIELD

The present disclosure relates to a furniture arrangement, and especially to the control of power supply to a furniture arrangement.

BACKGROUND

In offices the office furniture, such as a desk or other work surface, is equipped with a number of power consuming devices such as a computer, one or more computer screens, telephone, lights and/or a height adjusting arrangement of the piece of furniture itself. Many of these devices are left on, or in stand-by mode, when no one uses the work place. For instance the computer screens may be left on over night or over the weekend. All these devices will over time consume a large amount of power for no use. There are large amounts of money as well as environmental profit to gain if all these devices were turned off when not in use.

At present, the solution for this problem is to alert the user of the devices being turned on to try to get him or her to turn them off before leaving the work place. This may be done by lights on the devices. However, such alert lights have been provided on office devices for a long time, without achieving the desired effect.

Further, a main switch for the entire work place may be provided in order to facilitate a main turn off of the power supply to the devices. However, the action still relies on the user to turn off the switch.

Consequently, there is a need for a power supply control arrangement which facilitate power saving at an office work place.

SUMMARY

It is an object of the present invention to provide an improved solution that alleviates the mentioned drawbacks with present devices. Furthermore, it is an object to provide a furniture arrangement that enables an effective power consumption control of power consuming devices in connection to the arrangement.

According to an aspect of the invention this is achieved by a furniture arrangement comprising a piece of furniture and a control unit adapted to control the power supply to at least one power consuming device. The piece of furniture comprises an interface for connection to a mobile device, wherein the control unit is adapted to disconnect the power supply to the at least one power consuming device when a mobile device is not connected to the furniture arrangement via the interface.

In an office or workplace situation, a mobile device is an important tool for a work or user of the office or workplace. The mobile device may be used for a large number of purposes in the office. In the present invention, a mobile device may be adapted to be connected to the piece of furniture by means of an interface. The interface may be integrated in the piece of furniture. For instance, the piece of furniture may be a table and the interface may be integrated in the table top.

The connection of a mobile device to the piece of furniture via the interface may indicate the presence of a user. To save power consumption in a work place, the power consuming devices, such as office equipment, at a work place may be turned off when no one is using it. By forcing a user to connect a mobile communication to activate the power supply to the work place, the user may also be forced to deactivate the power supply when leaving the work place and bringing the mobile device. The power consuming devices may comprise a computer screen, a computer, lighting, electrically powered furniture or the like.

In one embodiment, the control unit may comprise a relay adapted to connect or disconnect the power supply to the at least one power consuming device, wherein said relay may be coupled to said interface.

The relay may be directly connected to the mains power supply, and may be controlled in response to the presence of a mobile device at the interface. The control unit may receive a signal from the interface indicating connection of a mobile device to the interface. This signal may be used to activate the relay, and thereby activating the power supply to the furniture arrangement.

In another embodiment, the piece of furniture may comprise a height adjustable table driven by an electric motor, and wherein the control unit may be adapted to disconnect the power supply to the electric motor when a mobile device is not connected to the furniture arrangement via the interface.

A height adjustable table may comprise at least one electric motor to drive the height adjusting function in the table. Such height adjusting function may consume at least a small amount of power also when in a stand-by mode. This may be due to a small electric detection signal in an electric circuit in the height adjustable table, which may be adapted to detect when a height adjusting signal is received for operating the electric motor to raise or lower the table. Such power may be consumed also when the work place at which the height adjustable table may be located is not in use. Further, the stand-by power consumption when the table or work place is not in use may be eliminated when the power supply to the table may be disconnected when a mobile device is not connected via the interface. Such absence of connected mobile device may indicate a non-use of the table or work place.

In a further embodiment, said mobile device may be a mobile phone.

A user of a furniture arrangement such as an office work place may nearly always have a mobile phone present, and may always bring it when leaving the work place. A mobile phone may thereby be a good way of identifying when the work place is in use or not. When a user leaves the work place and removes the mobile phone from the interface, the power supply to the work place may be disconnected to save power and prevent unnecessary power consumption. The mobile phone may for instance be a smart phone.

In one embodiment, the control unit may be adapted to receive information from the mobile device identifying a user, and wherein the control unit may be adapted to control the behavior of the power supply to the at least one power consuming device based on the information from the mobile device.

A furniture arrangement may be provided with a plurality of power consuming devices. Different users of a furniture arrangement may want or need access to different selections of devices. The mobile device may comprise information identifying the user and which devices he or she wants to be powered. The devices the user does not want may thereby not need to be powered, which may prevent unnecessary power consumption by unwanted devices. The furniture arrangement may be located in a facility comprising a plurality of similar furniture arrangements, such as an office landscape. A user may thereby get the same power settings regardless which work place in the office he or she may use.

In another embodiment, the control unit may be adapted to register power consumption of the furniture arrangement and to communicate the registered information to a mobile device via the interface.

An administrator of the furniture arrangement may be interested in how much power is consumed at a furniture arrangement. It may further be useful to know how much power a certain device connected to the furniture arrangement consumes. The control device may be adapted to measure and register how much power is consumed in the furniture arrangement. The power may be measured in total for the furniture arrangement and/or for different sections of the furniture arrangement, for instance for different devices. If the piece of furniture is a height adjustable table, the control unit may register how much power the table consumes. The control unit may be adapted to distribute the registered information to a connected mobile device. The mobile device may adapted to store the information, or distribute it further, for instance over a data communication network.

In one embodiment, said interface may be adapted for a wired connection with a mobile device.

The interface may comprise a cable attached to the piece of furniture and connected to the control unit. A mobile device may be connected to the cable to get in connection with the control unit. The control unit may get information of when a mobile device is connected to the cable. With a wired connection the mobile device may be communicatively connected to the interface by an established standard which allows many different devices to be compatible with said interface. For example the wired connection may be a USB-connection, mini-USB-connection, micro-USB-connection, 30-pin dock connector or other wired connections. Moreover, with a wired connector charging of the mobile device may be enabled. Further, the user may visually confirm that the mobile device is connected to the integrated interface.

In an alternative embodiment, said interface may be adapted for wireless connection with a mobile device.

The interface may comprise means for wireless connection with a mobile device. Such interface may comprise a specified area on the piece of furniture wherein the interface is adapted for wireless connection with the mobile device. The means for wireless communication may comprise means for WLAN connection, Bluetooth connection, Near Field Communication (NFC) connection, RFID connection or the like. The means for wireless connection to a mobile device may be adapted for detection of the presence of a mobile device. The control unit may thereby be adapted to control the power supply to the furniture arrangement based on the presence of a mobile device in the specified area of the interface. No physical connection between the mobile device and the interface may thereby be needed. The control unit may be adapted to disconnect the power supply to the furniture arrangement when a mobile device is disconnected from the interface. The control unit may however further be adapted to disconnect the power supply with a delay after disconnection of the mobile device. It may thereby be possible to remove the mobile device from the wireless interface for a short time without the power supply being disconnected. An immediate power disconnection when a user needs the mobile device may thereby be prevented. Alternatively, a deactivation of the power supply disconnection by the control unit may be possible to enable a temporary removal of the mobile device.

In a further embodiment, the wireless connection may be a near field communication connection.

With a near field communication connection the mobile device may be communicatively connected to the interface through that mobile device is brought into the close range of the interface. Moreover, the mobile device may be communicatively disconnected from the adjustable piece of furniture's interface through that the mobile device is brought out of range of the near field communication. Thereby a user may save time and effort on how to connect and disconnect the mobile device to the interface.

Moreover, a near field communication connection may be a relative secure connection due to the small range in which it is operable, typically a few centimeters. Moreover, buy using a near field communication connection, there may be no risk of accidently connecting the mobile device to a proximate work station in the scenario where several workplaces are situated next to each other to form a flexible working area.

In one embodiment, said interface may be integrated into the piece of furniture.

In a further embodiment, said piece of furniture may be a table, and said interface may be integrated into a table top of the table.

The interface may comprise a cable attached to the piece of furniture, or another physical connection means, such as a dock, for connection to the mobile device. The interface integrated in the piece of furniture may alternatively comprise a specified area, such as a specified area on the table top of the table, wherein which area the interface may be adapted for wireless connection to a mobile device. The control unit may thereby be adapted to control the power supply to the furniture arrangement based on the presence of a mobile device in the specified area of the interface. No physical connection between the mobile device and the interface may thereby be needed.

In another embodiment, the control unit may be adapted to be controlled by a mobile device connected to the furniture arrangement via the interface.

Thereby, when a mobile device is connected to the furniture arrangement via the interface and the power supply to the furniture arrangement is connected by the control unit, the power supply and power distribution in the furniture arrangement may further be controlled via the mobile device. The mobile device may be provided with means for control of the control unit. Such means may be software loaded into the mobile device. The mobile device may be used by a user to control the control unit. The mobile device may be provided with input means for a user to send control signals and get information to and from the control unit. Such signals may be used for controlling the power supply and power consumption within the furniture arrangement. The user may control settings of the power supply control by the control unit.

In one embodiment, the piece of furniture may be a height adjustable piece of furniture, and the control unit may further be adapted to control the operation of the height adjustment of the piece of furniture.

A height adjustable furniture, such as a height adjustable table, is a typical device that consumes power in a stand-by mode. Many solutions have been disclosed wherein the stand-by power by the table is reduced, but not eliminated. A height adjustable table normally comprises a control unit which controls the operation of the table. The table may comprise an electric motor which operates a linear actuator which in turn provides a raising or lowering of the table. The control unit may be adapted to control the operation of the electric motor. By using the same control unit for the power control of the furniture arrangement, the stand-by power by the table may be minimized or eliminated. The deactivation of the power supply when a mobile device is not connected to the interface may provide that a height adjustment of the table is only possible when a mobile device is connected to the interface. The stand-by mode of the table may thereby be turned off when a mobile device is not connected.

In another embodiment, the control unit may be adapted to be controlled by a mobile device connected to the interface, such that the operation of the height adjustment may be controlled by the mobile device.

The control unit may receive input from a connected mobile device. Such input may relate to the height adjustment of the height adjustable furniture. A mobile device connected to the interface may be provided by controlling means, such as software, adapted for sending control input to the control unit via the interface. A user of the work place and mobile device may thereby control the operation of the height adjustable furniture via the mobile device when the mobile device is connected to the interface.

BRIEF DESCRIPTION OF THE DRAWINGS

The invention will in the following be described in more detail with reference to the enclosed drawings, wherein.

DESCRIPTION OF EMBODIMENTS

Figure 1:
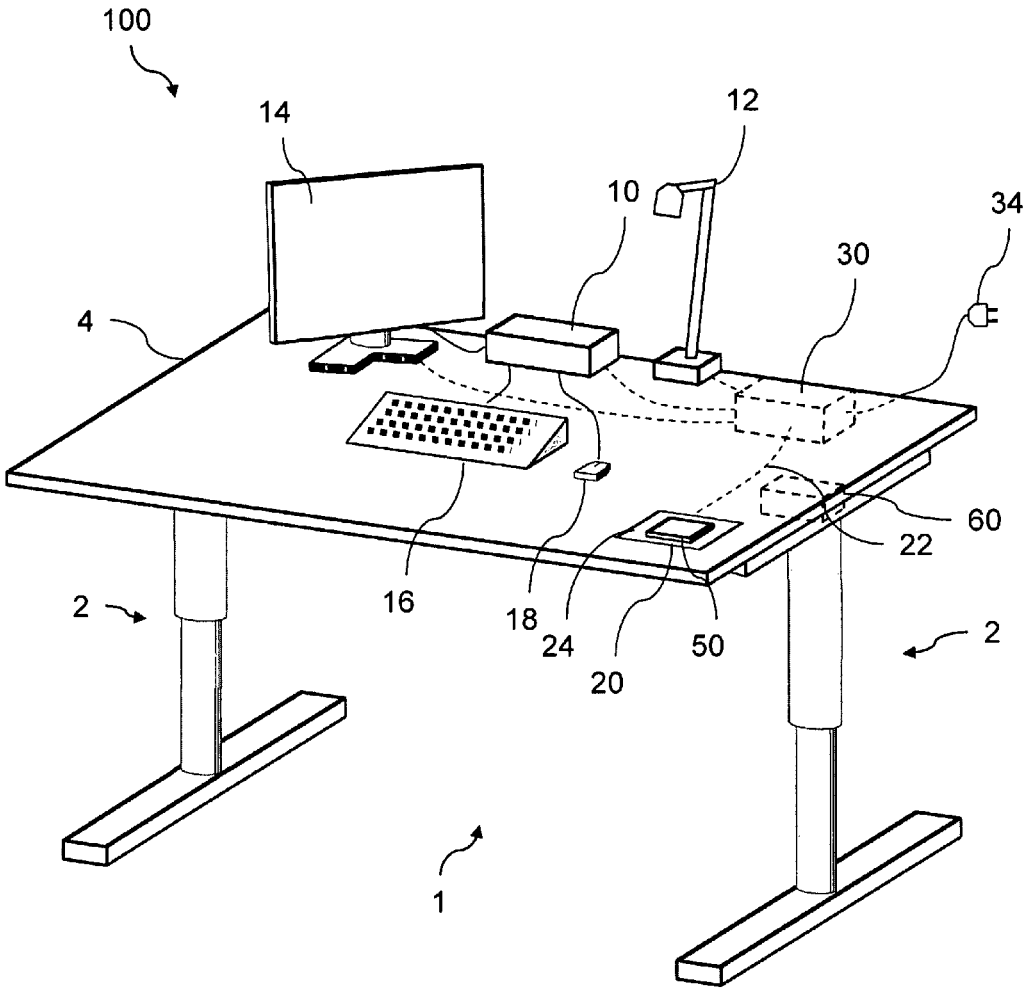
FIG. 1 is a perspective view of a furniture arrangement according to an embodiment of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

FIG. 1 illustrates a furniture arrangement 100 according to an embodiment. The furniture arrangement 100 comprises a piece of furniture illustrated as a table 1. The table 1 comprises two legs 2 and a table top 4. The legs 2 may be extendable in a telescopic manner providing a height adjustment function of the table 1. The height adjustment of the table 1 may be driven by one or more electric motors (not shown). The furniture arrangement 100 further comprises an interface 20 for communicative connection with a mobile device 50 such as a mobile telephone, a smart phone or a tablet computer. The furniture arrangement 100 further comprises a control unit 30. The control unit 30 is connected to a mains power supply network via a power plug 34. The control unit 30 thereby supplies power to the furniture arrangement 100. The control unit 30 comprises control means for controlling the operation of the power supply i.e. controlling the connection and disconnection of the power supply to the furniture arrangement 100.

The interface 20 is connected to the control unit 30 via a cable 22. In one embodiment, the interface 20 may be an integrated unit with the control unit 30.

When a mobile device 50 is connected to the interface 20, the control unit 30 receives a signal from the interface 20. When the control unit 30 receives a signal indicating a connection of a mobile device 50 to the interface 20, the control unit 30 activates the power supply to the furniture arrangement 100.

Further, when the mobile device 50 is disconnected from the interface 20, the control unit 30 receives a disconnecting signal or a termination of the connecting signal, indicating the disconnection. As a response to the disconnection of the mobile device 50 the control unit 30 disconnects the power supply to the furniture arrangement 100.

The connection or disconnection of the mobile device 50 to the interface 20 activates or terminates the power supply to the furniture arrangement 100.

The furniture arrangement 100 may be equipped with office equipment such as a computer 10, a computer screen 14, a telephone (not shown), lights 12 and the like, which all consume power, both when active and when in a stand-by mode. Further, the piece of furniture in the furniture arrangement 100, as the illustrated height adjustable table 1, consumes power also in an inactive stand-by mode. The power to all these devices may be disconnected when the mobile device 50 is disconnected from the interface 20. The power consumption during a stand-by mode of the furniture arrangement 100, i.e. when the devices connected to the control unit 30 is not actively used, may be minimized or eliminated.

When connected to the interface 20, the mobile device 50 may be charged by the control unit, via the connection to the interface 20.

Figure 2:
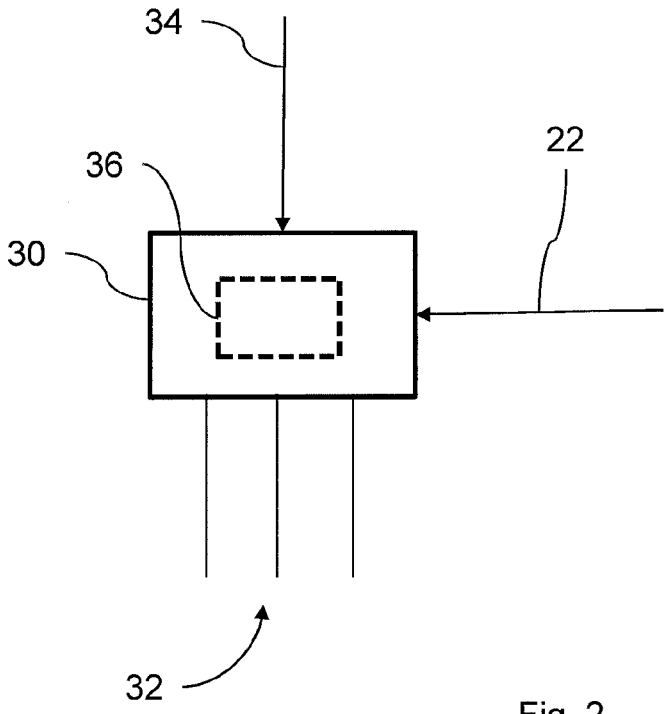
FIG. 2 is a schematic view of a control unit comprising a relay according to an embodiment of the invention.

FIG. 2 illustrates a schematic view of the connections to the control unit 30. The control unit 30 has a connection to the power plug 34 providing power supply input to the control unit 30. The control unit 30 further has a connection 22 to the interface 20. Via that connection 22 the control unit 30 receives information of whether a mobile device 50 is connected to the interface 20 or not. When the connection 22 indicates a connected mobile device 50, the control unit 30 activates power distribution through one or more power outlets 32. The power outlets 32 are connected to devices in the furniture arrangement, such as lights 12, a computer screen 14, the height adjustable table 1 and the like.

The control unit 30 may comprise a relay 36 controlled by the input connection 22 from the interface 20, and which relay 36, when activated, supplies power from the power supply 34 to the power outlets 32. In one embodiment, the control unit 30 itself consumes a small amount of power when the power supply to the power outlets 32 is disconnected, for a detection circuit (not shown) adapted to detect when a mobile device 50 is connected to the interface 20. In an alternative embodiment, the interface connection between the interface 20 and the mobile device 50 is provided as a switch, such that when a mobile device 50 is connected, the switch is closed which activates a relay 36 in the control unit 30 and the power supply to the power outlets 32 is activated. In such embodiment, the control unit 30 nor the interface 20 may consume any power when a mobile device 50 is not connected.

Figure 3:
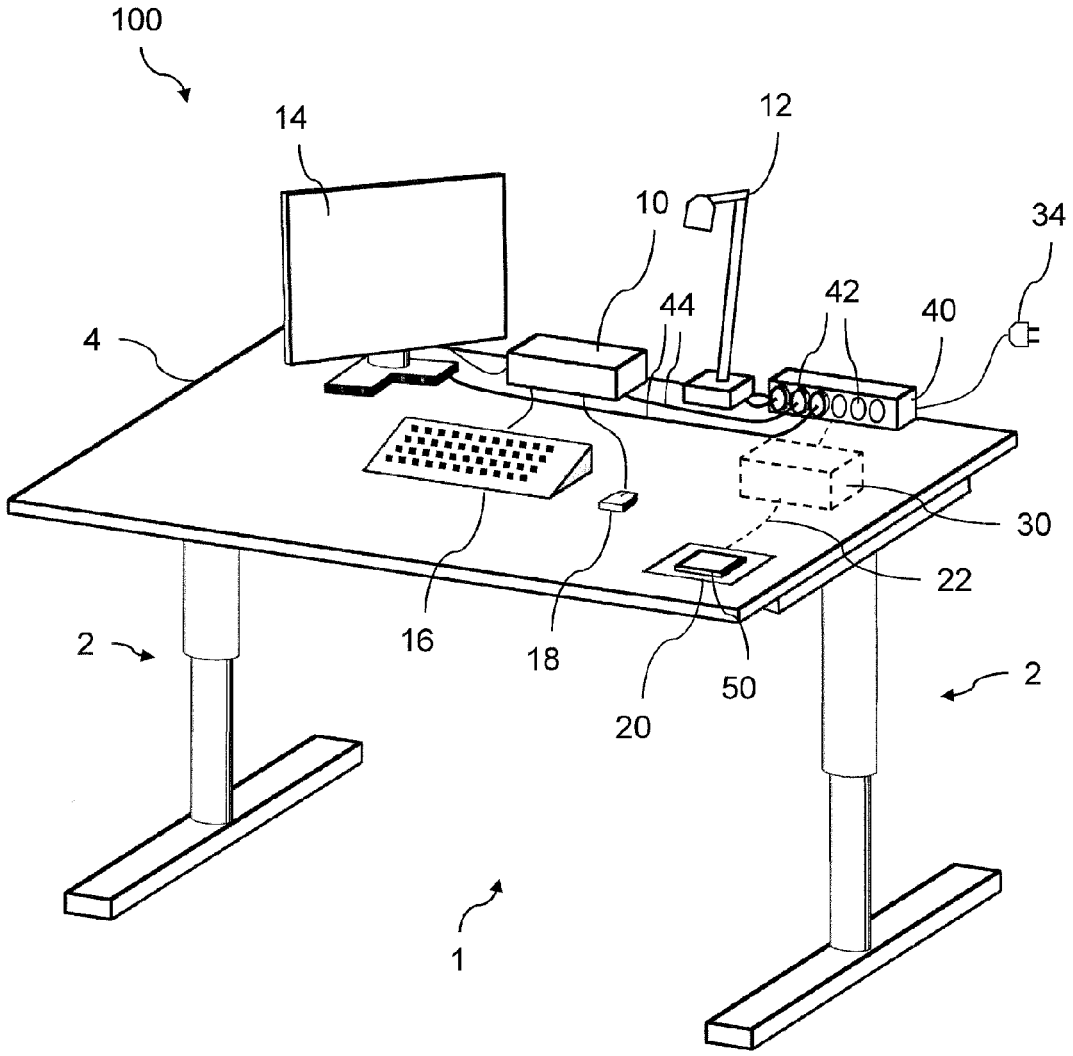
FIG. 3 is a perspective view of a furniture arrangement according to an embodiment of the invention.

FIG. 3 illustrates an alternative embodiment wherein the furniture arrangement 100 comprises a power supply unit 40 in connection with the control unit 30. The power supply unit 40 is adapted to supply power to the table 1 and/or the equipment provided at the furniture arrangement 100. The power supply unit 40 is provided with a plurality of power sockets 42 to which power consuming devices such as the computer 10, computer screen 14, light 12 etc. may be connected via power cables 44. The control unit 30 controls the operation of the power supply unit 40. As a response to the connection or disconnection of a mobile device 50 to the furniture arrangement 100 via the interface 20, the control unit 30 activates or deactivates the power supply from the power supply unit 40 through the power sockets 42.

In one embodiment, the power supply unit 40 may comprise a secondary power socket (not shown) which is not controlled by the control unit 30. Such power socket could be connected to a device which may not be wanted or suitable for power disconnection based on the connection of a mobile device 50 to the furniture arrangement 100. Such device may be a computer 10 which may be wanted to be kept powered also when a mobile device 50 is not connected via the interface 20.

Figure 4:
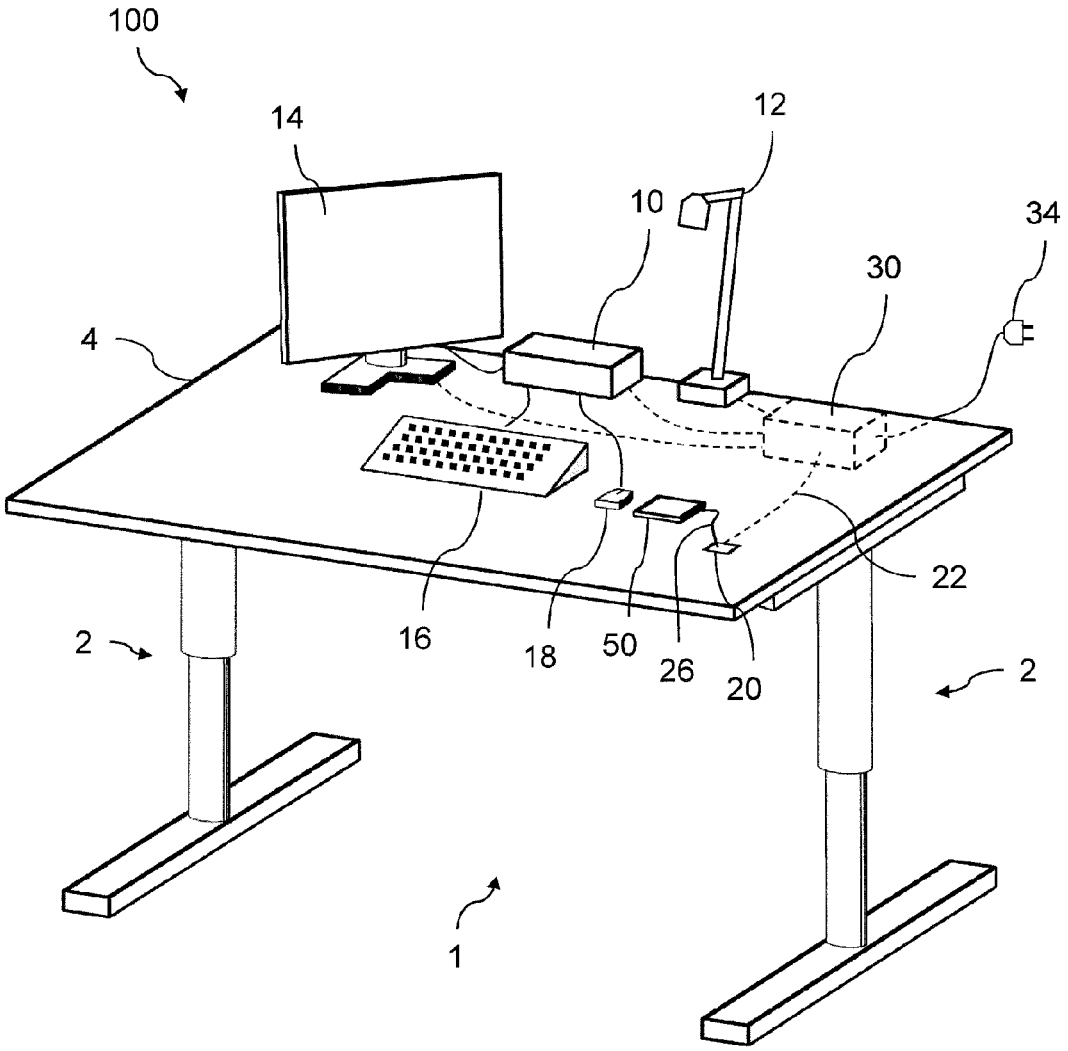
FIG. 4 is a perspective view of a furniture arrangement according to an embodiment of the invention.

The interface 20 between the table 1 and the mobile device 50 may be provided in a plurality of implementations. The interface 20 may be provided with a cable 26 for attachment and communicative connection with the mobile device 50 as illustrated in FIG. 4. The cable may be a USB cable or any other communication cable adapted for attachment to a mobile device 50. Alternatively, the interface may comprise wireless connection means 24 for wireless connection with the mobile device 50 as illustrated in FIG. 1. The wireless connection means may be adapted for connection to the mobile device 50 via WLAN, Bluetooth, Near Field Communication (NFC) or the like. The interface 20 is an integrated part of the table top 4. The wireless connection means of the interface is provided in a specified area 24 of the table top 4 as illustrated in FIG. 1. The control unit 30 controls the connection of the power supply to the furniture arrangement 100 based on the presence of a mobile device 50 in the specified area 24 on the table top 4.

In one embodiment, the control unit 30 is adapted to register the power supply to the furniture arrangement 100. It may further register the power consumption by different units or equipment connected to the control unit 20. Such register information may contain information of the time and/or the level of the power consumption for each device. The control unit 20 would thereby for instance register how much power the computer screen 14 has consumed, or how much power the height adjustable table 1 has consumed during a specified time period. The registered information may be stored in the control unit 30. Alternatively, the registered information may be stored in the mobile device 50 or a central server (not shown).

The power consumption information may further be communicated by the control unit 30 to a mobile device 50 connected to the furniture arrangement 100 via the interface 20. A user of the furniture arrangement 100 and the mobile device 50 may thereby be able to analyze the power consumption for different devices. The information may also be transferred further by the mobile device 50 to a central server (not shown) or an administrator.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A furniture arrangement, comprising, a piece of furniture, a control unit to control a power supply to at least one power consuming device based on detection of a mobile device, the at least one power consuming device being connected to the control unit by a cable, and an interface, which is integrated in the piece of furniture, for communicative connection with the mobile device, the interface and the power supply are provided at spaced apart portions of the piece of furniture, wherein the mobile device controls the control unit to control the power supply and power distribution in the furniture arrangement, and wherein the control unit disconnects the power supply to the at least one power consuming device when the mobile device is not connected to the furniture arrangement via the interface.

2. A furniture arrangement according to claim 1, wherein the control unit comprises a relay adapted to connect or disconnect the power supply to the at least one power consuming device, wherein said relay is coupled to said interface.

3. A furniture arrangement according to claim 1, wherein the piece of furniture comprises a height adjustable table driven by an electric motor, and wherein the control unit is adapted to disconnect the power supply to the electric motor when a mobile device is not connected to the furniture arrangement via the interface.

4. A furniture arrangement according to claim 1, wherein said mobile device is a mobile phone.

5. A furniture arrangement according to claim 1, wherein the control unit is adapted to receive information from the mobile device identifying a user, and wherein the control unit is adapted to control a behavior of the power supply to the at least one power consuming device based on information from the mobile device.

6. A furniture arrangement according to claim 1, wherein the control unit is adapted to register power consumption of the at least one power consuming device and to communicate the registered information to a mobile device via the interface.

7. A furniture arrangement according to claim 1, wherein said interface is adapted for a wired connection with a mobile device.

8. A furniture arrangement according to claim 1, wherein said interface is adapted for wireless connection with the mobile device.

9. A furniture arrangement according to claim 8, wherein said wireless connection is a near field communication connection.

10. A furniture arrangement according to claim 1, wherein said interface is integrated into the piece of furniture.

11. A furniture arrangement according to claim 1, wherein said piece of furniture is a table, and wherein said interface is integrated into a table top of the table.

12. A furniture arrangement according to claim 1, wherein the control unit is adapted to be controlled by a mobile device connected to the furniture arrangement via the interface.

13. A furniture arrangement according to claim 1, wherein the piece of furniture is a height adjustable piece of furniture, and wherein the control unit is further adapted to control an operation of the height adjustment of the piece of furniture.

14. A furniture arrangement according to claim 13, wherein the control unit is adapted to be controlled by a mobile device connected to the interface, such that the operation of the height adjustment is controlled by the mobile device.

15. The furniture arrangement as claimed in claim 1, further comprising a power outlet, wherein the at least one power consuming device is connected to receive said power supply via the power outlet, and wherein the power outlet is controllable by the control unit.

16. The furniture arrangement as claimed in claim 1, wherein the power outlet comprises at least one power socket to which the at least one power consuming device is connectable via a respective power cable.

17. The furniture arrangement as claimed in claim 16, wherein the at least one power consuming device is at least one of a computer, a computer screen, and a light.

18. A furniture arrangement according to claim 1, wherein the mobile device includes software to control the control unit.

19. A furniture arrangement according to claim 1, wherein the mobile device is provided with an input device for a user to send control signals and obtain information to and from the control unit.

20. A furniture arrangement according to claim 1, wherein when the mobile device is connected to the interface, the mobile device is charged by the control unit via the connection to the interface.

* * * * *